US006145217A

United States Patent [19]

Goebel

[11] Patent Number: 6,145,217

[45] Date of Patent: Nov. 14, 2000

[54] MACHINE FOR MANUFACTURING A MATERIAL WEB

[75] Inventor: Werner Goebel, Lauingen, Germany

[73] Assignee: Voith Sulzer Papermaschinen GmbH, Heidenheim, Germany

[21] Appl. No.: 09/104,181

[22] Filed: Jun. 25, 1998

[30] Foreign Application Priority Data

Jun. 25, 1997 [DE] Germany ..... 197 26 895

[51] Int. Cl.[7] ..... D06F 58/00

[52] U.S. Cl. ..... 34/117; 34/120

[58] Field of Search ..... 34/116, 117, 118, 34/120; 162/204, 206, 207, 210; 83/329, 330, 535, 536

[56] References Cited

U.S. PATENT DOCUMENTS

| | | | |
|---|---|---|---|
| 5,158,648 | 10/1992 | Weldon . | |
| 5,234,549 | 8/1993 | Weldon . | |
| 5,477,624 | 12/1995 | Haessner et al. | 34/117 |
| 5,515,619 | 5/1996 | Kahl et al. | 34/117 X |
| 5,557,863 | 9/1996 | Kokkala | 34/117 X |
| 5,560,123 | 10/1996 | Eskelinen | 34/117 X |
| 5,600,897 | 2/1997 | Sollinger | 34/115 |
| 5,718,058 | 2/1998 | Atzinger | 34/117 |
| 5,735,060 | 4/1998 | Atzinger et al. | 34/117 |
| 5,782,009 | 7/1998 | Kotischke | 34/117 |

FOREIGN PATENT DOCUMENTS

| | | |
|---|---|---|
| 0479748 A1 | 4/1992 | European Pat. Off. . |
| 0479748 B1 | 4/1992 | European Pat. Off. . |

*Primary Examiner*—Stephen Gravini
*Attorney, Agent, or Firm*—Greenblum & Bernstein, P.L.C.

[57] ABSTRACT

A machine for manufacturing a material web, in particular a paper or cardboard web, comprises a drying section that exhibits at least one drying group comprising two rows, including an upper and a bottom row of heatable drying cylinders, which are each assigned a transport belt, which is guided around the drying cylinder and the guide rollers assigned to the drying cylinders in a meandering fashion, whereby the material web is guided in an alternating manner around a drying cylinder of the top row and a drying cylinder of the bottom row and between the drying cylinders in a free stretch, and with at least one first nozzle, serving to transfer the threading strip, projecting a flow of gas essentially against the run direction of the material web. The machine includes a guide device positioned on the material web side opposite the first nozzle, which includes at least a second nozzle projecting a flow of gas essentially in the run direction of the material web.

17 Claims, 3 Drawing Sheets

MACHINE FOR MANUFACTURING A MATERIAL WEB

CROSS-REFERENCE TO RELATED APPLICATIONS

The present application claims priority under 35 U.S.C. § 119 of German Patent Application No. 197 26 895.1, filed on Jun. 25, 1997.

BACKGROUND OF THE INVENTION

1. Field of the Invention

The present invention relates to a machine for manufacturing a material web, in particular a paper or cardboard web, comprising a drying section comprising heatable drying cylinders wherein the material web is guided between and to successive drying cylinders.

2. Discussion of Background Information

Machines of for manufacturing a material web are known, and are disclosed, for example, in EP 0 479 748 B1. They comprise a drying section exhibiting a drying group with two rows. The drying group encompasses several drying cylinders arranged in an upper row and a bottom row, around which a material web is guided together with a transport belt. The material web is guided in a free stretch in the area between the drying cylinders, i.e. the material web is not supported by a transport belt in this area or zone. A known machine furthermore comprises of a nozzle device, serving to transfer a threading strip (also simply called a strip) providing a gas flow which runs against the run direction of the material web.

In the event of a web tear, or during the initiation of operation of the machine for manufacturing a material web, the threading strip is first cut out of the material web leaving a press section and then threaded through the drying section. This usually occurs at full operating speed of the material web manufacturing machine. It is therefore required that the threading strip be guided and stabilized, so that on the one hand it does not wrap around one of the drying cylinders, and on the other hand can be transferred safely in the transfer area between the upper and bottom row of drying cylinders. In the known machine, a nozzle device is used for this purpose and is located in the area of the opening nip of a drying cylinder, i.e. in the spool-off area, and which receives the material web from the drying cylinder, so that it can be transferred—viewed in the run direction of the material web—to the subsequent drying cylinder of the other row. It was demonstrated as a disadvantage that the transfer of the threading strip did not always occur safely, thereby often interrupting the threading process and requiring the cleaning of the drying section, which can result in machine downtime.

SUMMARY OF THE INVENTION

The invention provides a machine in which a safe threading of the material web or threading strip can be ensured.

The machine of the invention preferably includes a guide device, positioned on the material web side opposite a first nozzle device, and including at least a second nozzle device whose flow of gas is essentially pointed in the run direction of the material web. The flow of gas of the nozzle device pointed against the material web prevents the material web from adhering to a drying cylinder and from winding onto it. The guide device guides and stabilizes the threading strip, whereby the threading strip is supported by the flow of gas of the second nozzle device, directed in the run direction of the material web, and transferred safely—viewed in the run direction of the material web—to the subsequent drying cylinder of the other drying cylinder row. The flow of gas of the second nozzle device, pointed exclusively in the run direction of the material web, can furthermore be used to safely prevent the entanglement of the threading strip.

Preferably, the first nozzle device is mounted on a scraper, and the surface of the scraper facing the material web and the guide device surface facing the material web extend essentially parallel to each other. The scraper and the guide device define a uniform gap through which the material is guided. The material web is therefore guided on both sides so that is can be placed on the subsequent drying cylinder in the desired fashion.

An embodiment of the machine is furthermore preferred in which a cutting unit is designed that serves to cut off a threading strip from a material web. It is provided that the cutting unit is mounted on a cross rail stretching essentially across the width of the material web. The functional safety of the cutting unit can be particularly improved by positioning the cross rail—viewed in the run direction of the material web—in alignment behind the scraper. The scraper covers this cross rail such that an accumulation of material web shreds which fall from the material web when it is transferred, can be prevented in a safe manner. It is guaranteed, furthermore, that the cutting unit is positioned behind the cross rail in a concealed fashion during the threading process. By positioning the cutting unit directly behind the scraper, one can then realize a particularly compact construction of the machine.

In other aspects, the invention provides a machine for manufacturing a material web, the machine comprising a drying section comprising at least one drying group, the drying group comprising an upper row of heatable drying cylinders and a bottom row of heatable drying cylinders, each of the upper row and the lower row being provided with guide rollers and a transport belt which is guided around the drying cylinders and the guide rollers in a meandering fashion;

whereby the material web is guided in an alternating manner around a drying cylinder of the top row and a drying cylinder of the bottom row and between the drying cylinders in a free stretch, in a run direction;

at least one first nozzle constructed and arranged to project a flow of gas essentially against the run direction of the material web so as to transfer the material web from a heatable drying cylinder; and at least one second nozzle positioned on a material web side opposite the first nozzle and being constricted and arranged to project a flow of gas essentially in the run direction of the material web.

In preferred embodiments, the first nozzle is mounted on a scraper comprising a surface which faces the material web, and the second nozzle is mounted on a guide device comprising a surface which faces the material web, and wherein the surface of the scraper facing the material web and the surface of the guide device facing the material web are essentially parallel to each other.

The machine can also comprise a cutting device constructed and arranged to cut off a threading strip of a material web. The cutting device can also be positioned on a cross rail which at least essentially extends across the width of the material web. The cross rail, viewed in the run direction of the material web, can be positioned in alignment behind the scraper.

In other aspects, the invention provides a machine for manufacturing a material web, the machine comprising a drying section comprising at least one drying group;

the drying group comprising an upper row of heatable drying cylinders, each of the cylinders having an axis of rotation and being spaced along a first plane, and a bottom row of heatable drying cylinders, each of the cylinders having, an axis of rotation and being spaced along a second plane;

the upper row being provided with guide rollers, each having an axis of rotation, and a transport belt which is guided around the drying cylinders and the guide rollers in a meandering fashion;

the lower row being provided with guide rollers each having an axis of rotation, and a transport belt which is guided around the drying cylinders and the guide rollers in a meandering fashion;

whereby the material web is guided in an alternating manner around a drying cylinder of the top row and a drying cylinder of the bottom row and between the drying cylinders in a free stretch, in a run direction;

at least one first nozzle constructed and arranged to project a flow of gas essentially against the run direction of the material web so as to transfer the material web from a heatable drying cylinder; and at least one second nozzle positioned on a material web side opposite the at least one first nozzle and being constructed and arranged to project a flow of gas essentially in the run direction of the material web.

The guide rollers of the upper and lower rows can be arranged symmetrically with respect to the axes of rotation of the drying cylinders, such that each of the axes of rotation of the guide rollers of the upper row are in a plane with the axis of rotation of a drying cylinder of the lower row. Thus, the guide rollers of the upper row are co-planar with the drying cylinders of the lower row in an imaginary vertical plane and the guide rollers of the lower row are co-planar with the drying cylinders of the upper row in an imaginary vertical plane.

In such embodiments the first nozzle can be mounted on a scraper comprising a surface which faces the material web, and the second nozzle can be mounted on a guide device comprising a surface which faces the material web, and wherein the surface of the scraper facing the material web and the surface of the guide device facing the material web are essentially parallel to each other.

In various embodiments of the invention, the guide device can comprise a guiding plate.

In preferred aspects of these embodiments, the surface of the scraper facing the material web extends at an angle to (e.g., is not parallel to) the run direction of the material web.

The machine also preferably comprises a cutting device constructed and arranged to cut off a threading strip of a material web. The cutting device is preferably positioned on a cross rail which at least essentially extends across the width of the material web. Preferably, the cross rail, viewed in the run direction of the material web, is positioned in alignment behind the scraper.

In other preferred embodiments, the guide rollers of the upper and lower rows are arranged in an offset manner with respect the axes of rotation of the drying cylinders, such that each of the axes of rotation of the guide rollers of the upper row are not co-planar with the axis of rotation of a drying cylinders of the lower row and the axes of rotation of the guide rollers of the lower row are not co-planar with the axes of rotation of the drying cylinders of the upper row.

In certain preferred embodiments, the first nozzle is mounted on a scraper comprising a surface which faces the material web, and the flow of gas from the first nozzle defines an angle with respect to the surface of the scraper of from about −10° to about 30°, more preferably from about −5° to about 15°.

An additional nozzle can be mounted on the surface of the scraper facing the material web and the flow of gas from the additional nozzle is essentially in the run direction of the material web and defines an angle with respect to the surface of the scraper of from about 140° to about 180°, more preferably from about 155° to about 175°.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The machine described in the following can be used for manufacturing material webs in general. It is assumed herein, purely for the sake of example only, that a machine for manufacturing a paper web is at issue, i.e., a paper manufacturing machine as an illustrative but non-limiting example.

Figure 1:
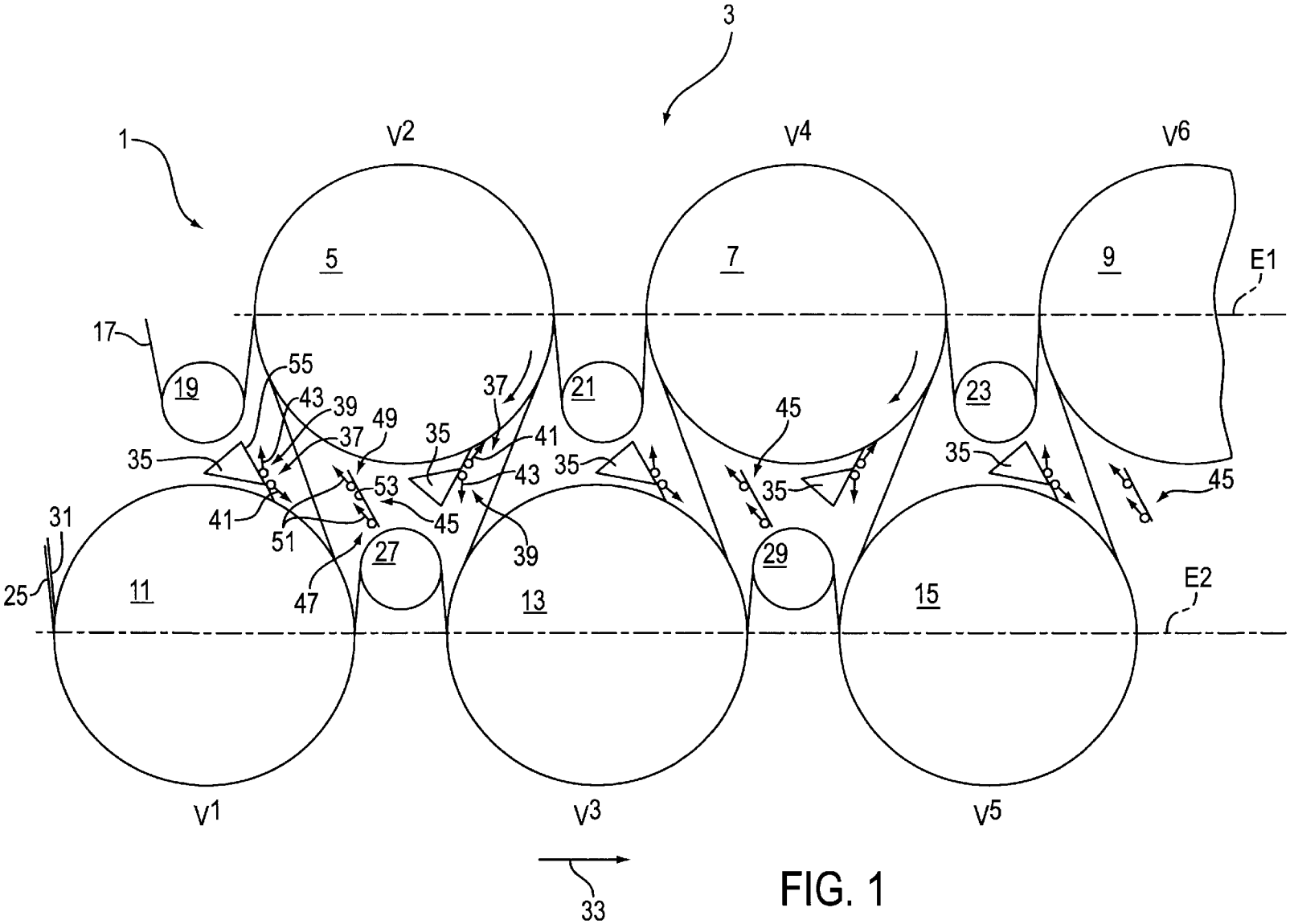
FIG. 1 illustrates a portion of a drying section in a schematic side view.

FIG. 1 schematically illustrates a section of a drying section 1 of a paper manufacturing machine, more specifically a portion of a drying group 3 having two rows, exhibiting several drying cylinders of which here only the drying cylinders 5 to 15 are illustrated. The axes of rotation of drying cylinders 5, 7 and 9 lie in an imaginary first plane E1 and drying cylinders 11, 13 and 15 in a second imaginary plane E2. The planes E1 and E2, illustrated with a dashed line, run parallel and are spaced at a distance from each other. A transport belt 17, also referred to as a drying sieve or drying felt, is assigned to the top row of drying cylinders 5, 7, 9 and is guided around the drying cylinders 5, 7, 9 of the top row and the guide rollers 19, 21, 23, assigned thereto, in a meandering fashion such that the belt is routed in such a way that it alternately engages a drying cylinder and guide roller, and such that this pattern is repeated for a length of the section of the drying section. Another transport belt 25 spools around the drying cylinders 11, 13 and 15 of the bottom row and the guide rollers, assigned thereto, also in a meandering fashion as above, whereby only guide rollers 27 and 29 are illustrated in FIG. 1.

A paper web, in the following generally referred to as material web 31, passes through the drying group 3 from the left to right (see arrow 33) and is thereby guided around a drying cylinder of the bottom row and a drying cylinder of the top row in an alternating fashion. In the section between the drying cylinder rows, the material web 31 is guided in a free stretch, meaning that the material web is not supported by any transport belts. A scraper 35 is preferably assigned to or associated with each of the drying cylinders of the drying group 3 and positioned in the spool-off area of the drying cylinder, i.e., in the area in which the material web 31 winds off the drying cylinder. The scrapers 35 are preferably constructed identically so that only scraper 35 assigned to drying cylinder 11 is described in the following. Preferably, the scraper 35 is placed on the surface of the drying cylinder 11 and prevents rejected scrap from spooling around the drying cylinder 11. The scraper 35 also serves to guide the "threading strip", also referred to as the "strip", which is created in the edge section of the material web 31 during start-up of the paper manufacturing machine to the drying cylinder 5 of the top row. The scraper 35 therefore may extend—depending on its function—across the entire width of the drying cylinder 11 or only over a portion of its width and is preferably located on the guiding side of the machine. Two nozzle devices 37 and 39 are preferably mounted on the scraper 35. The first nozzle device 37 comprises a blast pipe which ejects a flow of gas 41 that is pointed essentially against the run direction (preferably, generally toward the opposite direction of travel) of the material web 31. The nozzle device 39 also can comprise a blast pipe which ejects a flow of gas 43 that is directed essentially in the run direction (preferably, generally toward the same direction of travel) of the material web 31.

A guide device 45 is preferably included and positioned on the material web side opposite each of the scrapers 35, which cooperates with the drying cylinders 11, 13, 15 of the bottom row. In this embodiment the guide devices consist of two nozzle devices 47 and 49 that each exhibit a blast pipe from which a flow of gas 51 is ejected into the run direction of the material web 31. The guide device 45 is preferably constructed as a guiding plate with an enclosed or inwardly facing surface 53 facing the material web 31, preferably essentially running parallel to the surface 55 of the scraper 35 facing the material web 31, preferably making an acute angle with the material web 31 in the run direction. This creates a constant gap, i.e.—viewed in the run direction of the material web 31—a gap of equal width is formed between the scraper 35 and the guide device 45 through which the material web 31 is guided with the aid of the nozzle devices 37, 39, 47, 49. The material web 31 is practically supported by the flow of gas, whereby web twisting is preferably completely prevented or at least avoided to a large degree. The gas flows 43, 51, projecting into the run direction of the material web and serving the purpose of transferring the material web, exhibit the largest portion of the total gas flow volume used for transferring the material web/the threading strip.

During start-up of the paper manufacturing machine, or during a web tear, a threading strip is cut from the material web 31 by a cutting device, not illustrated here. The threading strip is guided together with the transport belt 25 of the bottom row around the drying cylinder 11 and spooled onto its circumference. The transport belt 25 is guided to the next drying cylinder 13 of the bottom row via a deflection roller 27 before the threading strip is lifted from the surface of the drying cylinder 11. The threading strip adhering to the drying cylinder 11 is lifted up by the flow of gas 41 ejecting from the nozzle device 37, guided by the gas flows 43 ejecting from the nozzle devices 39, 47, and 49 or, in other words, across the transfer region between the drying cylinders and finally fed into the nip between the transport belt 17 and the drying cylinder 5 of the top row. The threading strip is guided around the drying cylinder between the transport belt 17 and the drying cylinder 5. The transport belt 17 is also respectively lifted up from the drying cylinders 5, 7, 9 of the top row and guided to the next drying cylinder of the same row in the same manner, in this case first from drying cylinder 5 to drying cylinder 7.

As is evident from FIG. 1, only a scraper 35 is used to transfer the threading strip from a drying cylinder of the top row to a drying cylinder of the bottom row, for example from drying cylinder 5 to drying cylinder 13, whereby the scraper 35 is used not only to lift off the threading strip and to guide it in the region between drying cylinders but thereby also to fulfill the role as stabilizer. A guide device arranged on the opposite material web side as a guide device 45 is not necessary.

In this embodiment, the guide or deflection rollers 19, 21, 23, 27 and 29 of the drying group 3 are arranged symmetrically, meaning that the axes of rotation of the deflection rollers 27, 29 of the bottom drying cylinder series are each arranged in an imaginary, vertical plane (V2, and V4) in which the axes of rotation of a drying cylinder of the top row are also located respectively, here the axis of rotation of drying cylinder 5 or drying cylinder 7. The axes of rotation of the deflection rollers 19, 21, 23, assigned to the top row, are furthermore each arranged in an imaginary, vertical plane (V1, V3 and V5), in which the axis of rotation of a drying cylinder of the bottom row is also located. In this embodiment the guide rollers of the upper row are co-planar with the drying cylinders of the lower row and the guide rollers of the lower row are co-planar with the drying cylinders of the upper row, in vertical planes V1, V2, V3, V4, V5 and V6. The scraper 35 and the guide device 45 can, of course, be used in a drying group whose deflection rollers exhibit an asymmetrical arrangement, i.e. are positioned off-set to the drying cylinders, in which case the vertical planes of the deflection rollers of one group are not co-planar with the vertical planes of drying cylinders of the other group. Provisions are made, independent of the arrangement, that all drying cylinders of the drying group 3 are assigned a scraper 35 that can be constructed as a conventional cleaning scraper or as a transfer scraper. In order to realize a compact construction of the drying group, a scraper 35 is preferably constructed as a transfer scraper since it exhibits a more compact construction than a cleaning scraper and in particular exhibits a shorter length.

The blast pipes of the nozzle devices 37, 39, 47, 49 can each be activated individually with the aid of a control unit, not displayed here, which is described in the following text briefly using the term "actuation." It is furthermore possible to actuate the blast pipes mounted on the scraper 35 simultaneously, to actuate several blast pipes, for example two to twenty blast pipes, or to actuate all blast pipes in the drying group 3 at the same time. The blast pipes can also each exhibit a separate air volume adjustment unit and/or each be independently or collectively actuated via a separate solenoid valve. The blast pipes can furthermore be time-delayed, i.e., be activated and deactivated sequentially, preferably depending on the position of the free end of the threading strip within the drying section, so that the air volume, required for the guidance and stabilization of the threading strip, is kept relatively low.

Figure 2:
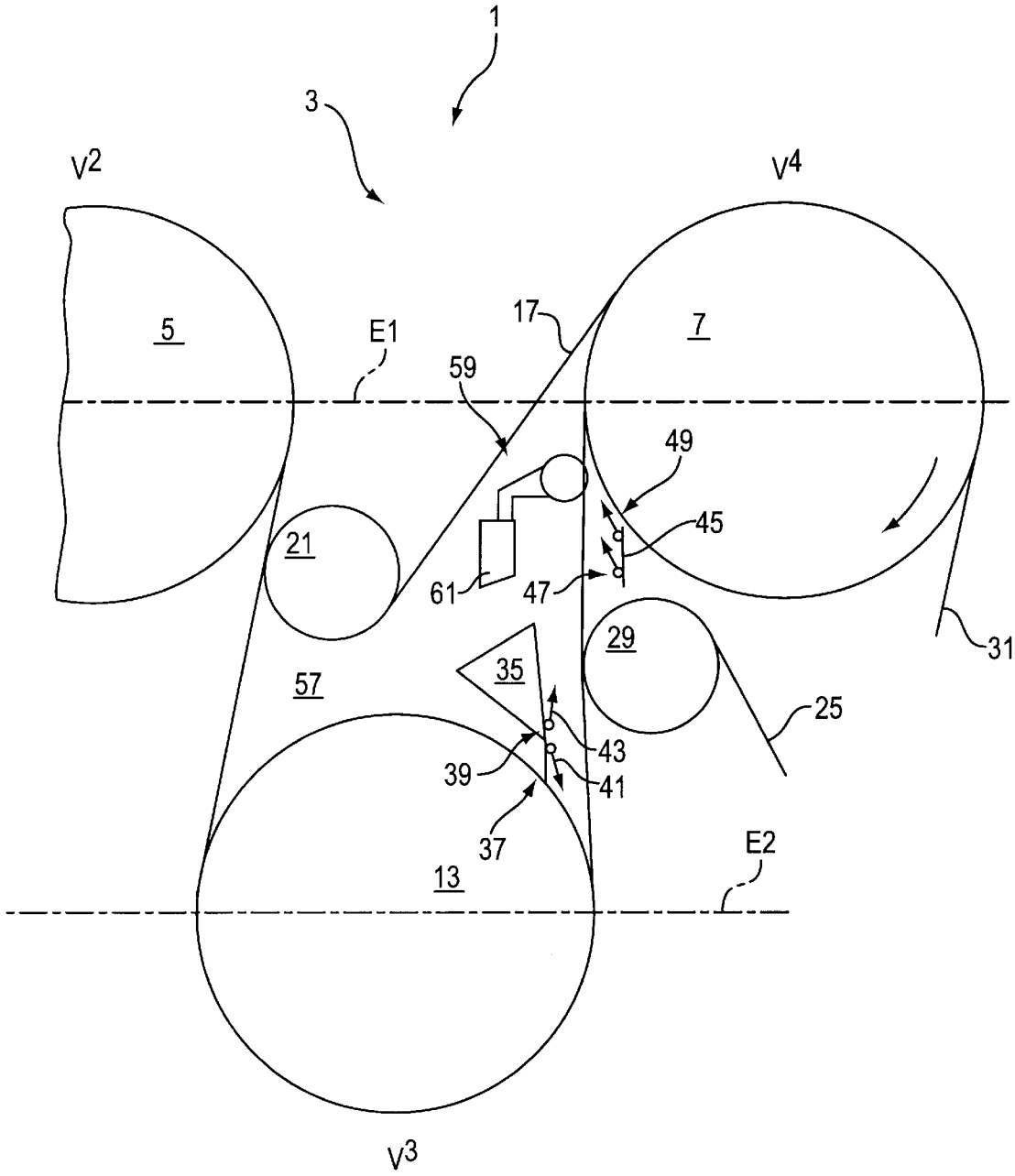
FIG. 2 illustrates a section of another embodiment of the drying section in schematic side view.

FIG. 2 shows a schematic side view of a section of an embodiment of the drying group 3. Identical parts are referenced using the same or like reference symbols so that one can refer back to the description of FIG. 1. The deflection rollers 21 and 29 of the top and bottom drying cylinder row are arranged in an asymmetrical manner here, meaning that the axis of rotation of the deflection roller 21 is offset to the left to vertical plane V8 with respect to the imaginary vertical plane V3 of the axis of rotation of the drying cylinder 13. The axis of rotation of the deflection roller 29 likewise is shifted to the left to vertical plane V9 in the same manner. A free space, also referred to as a pocket, is bounded by the material web 31, being guided in a free stretch from drying cylinder 5 to drying cylinder 13 and from it to drying cylinder 7, and the transport belt 17 which is guided around the deflection roller 21. The cutting device 59, serving the purpose of cutting off a threading strip from the material web, and the scraper 35 are placed in this pocket. The cutting device 59 is arranged on a cross rail 61 that extends across the width of the material web 31. The cutting device 59 can traverse on the cross rail 61. The cross rail 61—viewed in the run direction of the material web 31—is placed in alignment behind the scraper 35, in relation to the direction of the direction of travel of the material web 31. The scraper 35 covers the cross rail 61 completely in an advantageous manner, thereby avoiding any material web shreds from accumulating on the cross rail 61. Advantageously, the transfer process is also not obstructed. One can thereby ensure a high degree of functional safety of the cutting device 59 and also reduce the length of the drying section 1 by arranging the cutting device 59 in the free space 57. The cutting device 59, illustrated here, is designed to provide a threading strip for threading the material web into a subassembly of the manufacturing machine that follows the drying group. The cutting device 59 is therefore preferably placed at the end of the drying group 3.

In the embodiment of the drying group 3 illustrated in FIG. 2, the entire material web 31 is guided to the drying cylinder 13 of the bottom row after the start-up of the paper manufacturing machine or after a web tear. The material web 31 unwinds together with the transport belt 25 from the drying cylinder 13. The nozzle device 37, mounted on the scraper 35 or, in other words, the flow of gas 41 therefrom thereby ensures that the material web 31 does not stick to the circumference of the drying cylinder 13, but that it spools off together with the transport belt 25. The deflection roller 29 over which the transport belt 25 is guided, is positioned in the embodiment illustrated in FIG. 2, such that the transport belt 25 is only separated from the material web 31 when it is in the transfer region between the bottom and top drying cylinder rows. The free stretch is thereby shortened so that the overall guidance mechanism is improved. A threading strip, cut from the material web 31 with the aid of the cutting device 59 in the region of the free stretch, is guided around the drying cylinder 7 and on through the rest of the drying section and the subsequent subassembly. A guide device 45 is arranged on the material web side opposite the cutting device 59 to first safely transfer the material web 31, then the cut-off threading strip, and then the remaining web to the drying cylinder 7, thereby stabilizing the material web 31.

In another embodiment, the cutting device 59—viewed in the run direction of the material web—is immediately followed by another subassembly, such as a treatment unit. This means that the cutting device 59 is positioned at the end of the drying section so that the threading strip or material web can be transferred out of the drying section after passing through the cutting machine 59 and guided to the subsequent assembly group.

Figure 3:
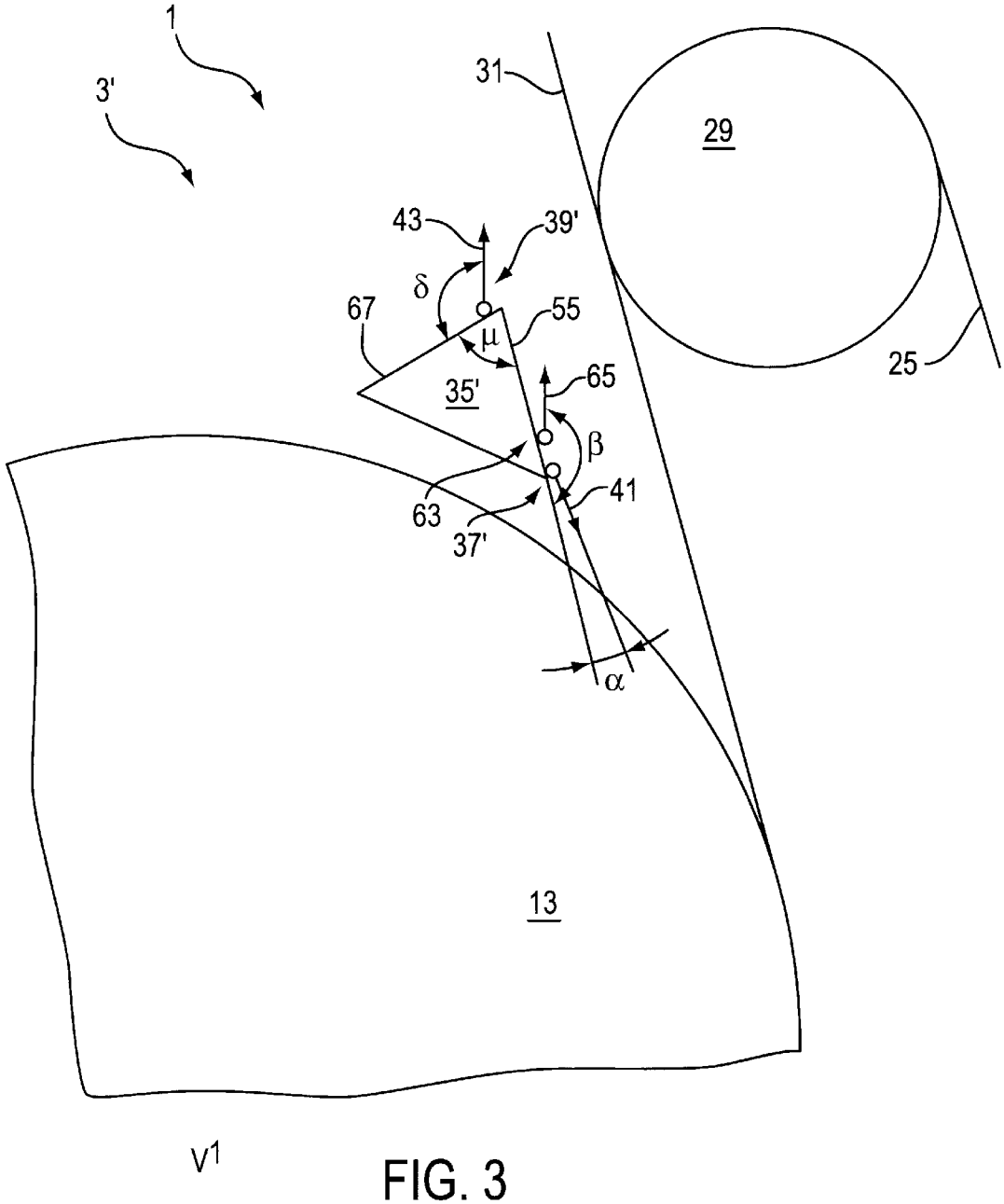
FIG. 3 illustrates a schematic side view of a portion of a third embodiment of the drying section.

FIG. 3 shows a portion of a drying section 1 on a highly enlarged scale, more specifically, a drying cylinder 13 and a deflection roller 29 of a drying group 3'. Parts that are identical to those in FIGS. 1 and 2 are referenced with the same or like reference symbols so that one can refer back to their descriptions in FIGS. 1 and 2. The following explains the construction of the scraper 35' in more detail. The scraper 35' lies on the circumference of the drying cylinder 13 and, on one hand, serves to transfer onto the deflection roll the threading strip, guided around the drying cylinder 13 during the start-up of the paper machine, further into the direction of a drying cylinder, not illustrated here. On the other hand, the scraper 35' prevents the spooling of material web shreds and scrap during a web tear. Several, here a total of three, nozzle devices 37', 39', and 63 are mounted on the scraper 35'. The first nozzle device 37'—viewed in the run direction of the material web—is the nozzle device positioned furthest to the front (i.e., the furthest upstream with respect to the direction of travel of the web) and comprises a blast pipe exhibiting at least a single jet from which the flow of gas 41 is ejected, as indicated by an arrow. The material web can be easily lifted from the drying cylinder circumference with the converging blast using an inexpensive single jet on an unlimited area of the drying cylinder. The single jet can be provided a wedge-shaped cover that screens the flow of gas 41 or directs it so that it hits the desired location on the drying cylinder. The flow of gas 41 is directed against the run direction of the material web 31 and defines an angle $\alpha$ with the surface 55 of the scraper 35' facing the material web 31 that ranges from about −10° to about 30°, but preferably ranges from about −5° to about 15°. A negative angle refers to a direction of the gas flow 41 that is pointed against the surface 55 of the scraper 35'. The flow of gas 41 is directed to the surface of the drying cylinder 13 and peels off the threading strips should they remain stuck on the surface of the drying cylinder 13.

The subsequent or downstream nozzle device 63, viewed in the run direction of the material web, exhibits a blast pipe consisting of a slit jet from which the flow of gas 65 is ejected. The flow of gas 65 forms an angle $\beta$ with the surface of the scraper 35', ranging from 140° to 180°, but is preferably chosen from 155° to 175°. The flow of gas 65 is therefore essentially pointed in the direction of the material web 31. A uniform gas curtain is achieved with the aid of the slit jet so that a twisting of the material web or the threading strip is prevented in a safe manner.

The two nozzle devices 37' and 63 are preferably arranged at a very small distance from each other and are located in the section of the leading edge of the scraper 35' placed on the drying cylinder 13. The nozzle device 39' is mounted on the opposite edge of the scraper 35', the side facing away from the drying cylinder 13, and comprises a blast pipe from which a flow of gas 43 is ejected. The flow of gas 43 serves to transfer the threading strip from the bottom drying cylinder row to the top cylinder row and is oriented such that it hits the material web 31 in an acute angle. The flow of gas 43 forms an angle $\delta$ with the surface 67 of the scraper 35', ranging from about 90° to about 150°, but is preferably chosen in the range of from about 100° to about 130°. The surface 67 of the scraper 35' encloses an angle $\mu$ with the surface 55 of the scraper 35' facing the material web 31, and measures around 75°. If need be, one can eliminate the nozzle device 39' and/or the nozzle device 63. Their use depends on the material web properties, in particular, on its moisture.

The threading strip is peeled off the surface of the drying cylinder 13 with the aid of the flow of gas 41 of the nozzle device 37', directed against the run direction of the material web 31, and laid against the surface of the transport belt 25 before the threading strip runs onto the scraper 35'. The threading strip is accelerated in the transfer region between the drying cylinder rows with the aid of the gas flows 65 and 43 which are essentially pointed in the run direction of the material web 31. The threading strip is thus stretched tight and finally guided to the subsequent drying cylinder. A guide device 45, discussed above with respect to FIG. 1, can be designed above the web guidance roller 29 and exhibit a flow of gas that points essentially in the run direction of the material web. The material web 31 is thus supported on both sides by a flow of gas, thereby enabling a very safe transfer.

The orientation or positioning of the gas flows of the nozzle devices 37, 39, 47, 49, 63 occurs with the aid of clamping units that fixate the blast pipes of the nozzle devices. These clamping units allow the angles of the blast pipes to be adjusted in an infinitely variable manner.

Overall, it becomes clear, based on the teachings herein, that the threading strip can be guided in a particularly safe manner and stabilized with the aid of the gas flow distribution mechanism illustrated in FIGS. 1 to 3. The threading strip is first lifted off the surface of the drying cylinder with the aid of the gas flow 41 and guided through the free stretch (from the bottom to the top drying cylinder rows) between the gas flow 43 of the nozzle device 39 or 39' and the gas flow 51 of the guide device 45. A reliable transfer of the threading strip can be ensured by guiding the material web 31 between two gas flows. The components used for transferring the threading strip are inexpensive and can be used universally for any drying sections. Particularly advantageous is, furthermore, that the existing drying sections that exhibit a conventional transport belt guidance mechanism can be retrofit with the scraper 35 or 35' and the guide device 45.

The blast nozzles of each of the embodiments of FIGS. 1–3 can be provided in optimum shapes and configurations. In this regard, the blast nozzles of the embodiments of FIGS. 1 and 2 can also be in the form of a slit so as to provide a blast of air in the form of a curtain, as has been described above with respect to the embodiment of FIG. 3.

In certain embodiments, terms used in reference to air flow "exclusively against" the run direction of the material web refers to a direction of air flow which has no component toward the direction of run of the material web and at least some component which is against the direction of the material web. The terms "exclusively toward" the run direction of the material web refers to a direction of air flow which has no component opposite to or against the direction of run of the material web and at least some component which is toward the direction of the material web. In this regard, some embodiments, the flow of gas from a first nozzle device can be pointed exclusively against the run direction and the flow of gas from a second nozzle device can be pointed exclusively in the run direction of the material web.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A machine for manufacturing a material web, the machine comprising a drying section comprising at least one drying group, the drying group comprising an upper row of heatable drying cylinders and a lower row of heatable drying cylinders, each of the upper row and the lower row being provided with guide rollers and a transport belt which is guided around the drying cylinders and the guide rollers in a meandering fashion;

whereby the material web is guided in an alternating manner around a drying cylinder of the top row and a drying cylinder of the bottom row and between the drying cylinders in a free stretch, in a run direction;

at least one first nozzle constructed and arranged to project a flow of gas essentially against the run direction of the material web so as to transfer the material web from a heatable drying cylinder;

at least one second nozzle positioned on a material web side opposite the at least one first nozzle and being constructed and arranged to project a flow of gas essentially in the run direction of the material web; and further comprising a cutting device constructed and arranged to cut off a threading strip of a material web.

2. The machine of claim 1, wherein the first nozzle is mounted on a scraper comprising a surface which faces the material web, and the second nozzle is mounted on a guide device comprising a surface which faces the material web, and wherein the surface of the scraper facing the material web and the surface of the guide device facing the material web are essentially parallel to each other.

3. The machine of claim 1, wherein the cutting device is positioned on a cross rail which at least essentially extends across the width of the material web.

4. The machine of claim 3, wherein the cross rail, viewed in the run direction of the material web, is positioned in alignment behind the scraper.

5. A machine for manufacturing a material web, the machine comprising a drying section comprising at least one drying group;

the drying group comprising an upper row of heatable drying cylinders, each of the cylinders having an axis of rotation and being spaced along a first plane, and a bottom row of heatable drying cylinders, each of the cylinders having an axis of rotation and being spaced along a second plane;

the upper row being provided with guide rollers, each having an axis of rotation, and a transport belt which is guided around the drying cylinders and the guide rollers in a meandering fashion;

the lower row being provided with guide rollers each having an axis of rotation, and a transport belt which is guided around the drying cylinders and the guide rollers in a meandering fashion;

whereby the material web is guided in an alternating manner around a drying cylinder of the top row and a drying cylinder of the bottom row and between the drying cylinders in a free stretch, in a run direction;

at least one first nozzle constructed and arranged to project a flow of gas essentially against the run direction of the material web so as to transfer the material web from a heatable drying cylinder; and at least one second nozzle positioned on a material web side opposite the at least one first nozzle and being constructed and arranged to project a flow of gas essentially in the run direction of the material web.

6. The machine of claim 5 for forming a web, wherein the guide rollers of the upper and lower rows are arranged symmetrically with respect to the axes of rotation of the drying cylinders, such that each of the axes of rotation of the guide rollers of the upper row are in a plane with the axis of rotation of a drying cylinder of the lower row.

7. The machine of claim 6, wherein the first nozzle is mounted on a scraper comprising a surface which faces the material web, and the second nozzle is mounted on a guide device comprising a surface which faces the material web, and wherein the surface of the scraper facing the material web and the surface of the guide device facing the material web are essentially parallel to each other.

8. The machine of claim 7, wherein the guide device comprises a guiding plate.

9. The machine of claim 8, wherein the surface of the scraper facing the material web extends at an angle to the run direction of the material web.

10. The machine of claim 6, further comprising a cutting device constructed and arranged to cut off a threading strip of a material web.

11. The machine of claim 10, wherein the cutting device is positioned on a cross rail which at least essentially extends across the width of the material web.

12. The machine of claim 11, wherein the cross rail, viewed in the run direction of the material web, is positioned in alignment behind the scraper.

13. The machine of claim 5 for forming a web, wherein the guide rollers of the upper and lower rows are arranged in an offset manner with respect the axes of rotation of the drying cylinders, such that each of the axes of rotation of the guide rollers of the upper row are not co-planar with the axis of rotation of a drying cylinders of the lower row and the axes of rotation of the guide rollers of the lower row are not co-planar with the axes of rotation of the drying cylinders of the upper row.

14. The machine of claim 13, wherein the first nozzle is mounted on a scraper comprising a surface which faces the material web, and the flow of gas from the first nozzle defines an angle with respect to the surface of the scraper of from about −10° to about 30°.

15. The machine of claim 14, wherein the angle is from about −5° to about 15°.

16. The machine of claim 14, wherein an additional nozzle is mounted on the surface of the scraper facing the material web and the flow of gas from the additional nozzle is essentially in the run direction of the material web and defines an angle with respect to the surface of the scraper of from about 140° to about 180°.

17. The machine of claim 16, wherein the angle is from about 155° to about 175°.

* * * * *

UNITED STATES PATENT AND TRADEMARK OFFICE

CERTIFICATE OF CORRECTION

PATENT NO. : 6,145,217

DATED : November 14, 2000

INVENTOR(S) : W. GOEBEL

It is certified that error appears in the above-identified patent and that said Letters Patent is hereby corrected as shown below:

On the cover of the printed patent, at Item [73], Assignee, "Papermaschinen" should be ---Papiermaschinen---.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*